US009648925B2

(12) United States Patent
Kramer

(10) Patent No.: US 9,648,925 B2
(45) Date of Patent: May 16, 2017

(54) FOOTWEAR DEVICES

(71) Applicant: Hyman Kramer, Bronx, NY (US)

(72) Inventor: Hyman Kramer, Bronx, NY (US)

( * ) Notice: Subject to any disclaimer, the term of this patent is extended or adjusted under 35 U.S.C. 154(b) by 0 days.

(21) Appl. No.: 14/862,909

(22) Filed: Sep. 23, 2015

(65) Prior Publication Data

US 2017/0079377 A1 Mar. 23, 2017

(51) Int. Cl.

*A43B 13/18* (2006.01)
*A43B 7/24* (2006.01)
*A43B 21/26* (2006.01)

(52) U.S. Cl.

CPC ..... *A43B 13/181* (2013.01); *A43B 7/24* (2013.01); *A43B 13/186* (2013.01); *A43B 13/188* (2013.01); *A43B 21/26* (2013.01)

(58) Field of Classification Search

CPC ..... A43B 13/18; A43B 13/181; A43B 13/184; A43B 13/186; A43B 13/188; A43B 21/23; A43B 21/26
USPC ..... 36/28, 35 R, 37, 142–144
See application file for complete search history.

(56) References Cited

U.S. PATENT DOCUMENTS 1,165,235 A 12/1915 Emery
RE20,381 E 5/1937 Murray
2,350,362 A * 6/1944 Margolin ..... A43B 21/26 36/3 B
2,387,029 A * 10/1945 Kellman ..... A43B 21/38 36/35 R
2,423,753 A 7/1947 Brooks
2,540,449 A 2/1951 Kaufmann
2,648,916 A 8/1953 Greissinger
2,844,833 A 7/1958 Odermatt
2,863,230 A * 12/1958 Cortina ..... A43B 13/20 36/29
3,087,264 A * 4/1963 McKinley ..... A43B 21/433 36/35 R
3,267,592 A 8/1966 Champion
3,738,373 A * 6/1973 Glancy ..... A43B 21/26 36/144
4,364,188 A * 12/1982 Turner ..... A43B 5/06 36/129
4,364,189 A * 12/1982 Bates ..... A43B 5/06 36/129
4,730,402 A * 3/1988 Norton ..... A43B 13/187 36/114
4,887,367 A 12/1989 Macness et al.
5,077,916 A * 1/1992 Beneteau ..... A43B 5/001 36/128
5,367,791 A 11/1994 Gross et al.
5,493,791 A 2/1996 Kramer
5,775,005 A 7/1998 McClelland
5,860,229 A 1/1999 Morgenstern
6,205,684 B1 3/2001 Snyder
6,874,251 B2 4/2005 Moretti
6,920,705 B2 * 7/2005 Lucas ..... A43B 3/0063 36/142

(Continued)

OTHER PUBLICATIONS

International Search Report and Written Opinion for Application No. PCT/US14/47081 mailed Nov. 21, 2014.

*Primary Examiner* — Marie Bays
(74) *Attorney, Agent, or Firm* — Merchant & Gould, PC

(57) ABSTRACT

Footwear devices having various shock absorbing configurations situated in the heal of the footwear and a plurality of regions on the bottom of the footwear defined by a plurality of compressibilities.

15 Claims, 9 Drawing Sheets

(56) References Cited

U.S. PATENT DOCUMENTS 6,931,765 B2 * 8/2005 Lucas ..... A43B 3/0063 36/28
7,000,334 B2 2/2006 Gillespie
7,200,955 B2 4/2007 Foxen
7,712,231 B2 * 5/2010 Umezawa ..... A43B 5/00 36/142
8,220,182 B2 * 7/2012 Righetto ..... A43B 7/144 36/141
8,607,475 B2 12/2013 Nakano
8,984,771 B1 * 3/2015 Kramer ..... A43B 13/14 36/28
2003/0061733 A1 4/2003 Karsten
2006/0117603 A1 6/2006 Park
2006/0130365 A1 * 6/2006 Sokolowski ..... A43B 3/0042 36/35 R
2006/0156579 A1 * 7/2006 Hoffer ..... A43B 1/0009 36/28
2006/0283046 A1 * 12/2006 Mason ..... A43B 3/0042 36/28
2007/0277401 A1 12/2007 Young-Chul
2008/0313924 A1 12/2008 Righetto
2010/0139120 A1 6/2010 Manz et al.
2011/0072684 A1 * 3/2011 Stubblefield ..... A43B 13/122 36/29
2011/0126422 A1 * 6/2011 Vattes ..... A43B 7/144 36/10
2011/0225842 A1 * 9/2011 Lu ..... A43B 21/26 36/27
2012/0055048 A1 3/2012 Haupt et al.
2012/0085002 A1 4/2012 Healy et al.
2014/0082972 A1 3/2014 Jones
2015/0289587 A1 * 10/2015 Kramer ..... A43B 13/14 36/28
2015/0289588 A1 * 10/2015 Kramer ..... A43B 13/181 36/28

* cited by examiner

FOOTWEAR DEVICES

BACKGROUND

Gait varies from person to person depending on the biomechanical characteristics or other factors. FIG. 1 shows three typical manners in which the foot contacts the ground, from left to right, pronated, neutral/normal, and supinated. Briefly, in pronation the foot takes on a position in which most of the body weight is loaded onto the inner edge of the foot. On the contrary, in supination the foot takes on a position in which the body weight is loaded onto the outer edge of the foot.

From the biomechanical viewpoint, it is correct to rest the foot on the ground in the neutral manner. Excessive pronation or supination is the source of many lower extremity problems, including muscle tiredness, knee joint pain, tendinitis, ligament strain, and even neurological damage.

SUMMARY

In general terms, this application relates to footwear (e.g. a shoe) and associated footwear components. The disclosures herein are not limited to any particular type of footwear and will be readily applied by those skilled in the art to a variety of types of footwear, including but not limited to sneakers, sandals, dress shoes, flats, high-heeled shoes, boots, slippers, open-toed shoes, close-toed shoes, and so forth. In some embodiments, a footwear heel device includes a shock absorber at least partially disposed within a bore. In some embodiments the shock absorber includes a compressible material that compresses longitudinally while expanding transversely. In some embodiments, the shock absorber includes a flange to prevent the shock absorber from falling through the bore. In other embodiments, the footwear devices include heel caps configured to work together with the shock absorber and the heel. In still further embodiments, footwear includes a heel device at least partially disposed within a bore, and a sole such that at least a portion of the sole has a compressibility that differs from the compressibility of the heel device.

In one aspect, a footwear device comprises: a sole, the sole having a bottom surface, an outer edge and an inner edge, the footwear device being defined by a plurality of regions between the outer edge and the inner edge, the footwear device being further defined by a plurality of compressibilities; wherein a first of the plurality of regions is disposed nearer the outer edge than a second of the plurality of regions; wherein the first of the plurality of regions has a first of the plurality of compressibilities; wherein the second of the plurality of regions has a second of the plurality of compressibilities; and wherein the first of the plurality of compressibilities is less than the second of the plurality of compressibilities.

In another aspect, a footwear device comprises a sole, the sole having a bottom surface, an outer edge and an inner edge, the footwear device being defined by a plurality of regions between the outer edge and the inner edge, the footwear device being further defined by a plurality of compressibilities; wherein a first of the plurality of regions is disposed nearer the inner edge than a second of the plurality of regions; wherein the first of the plurality of regions has a first of the plurality of compressibilities; wherein the second of the plurality of regions has a second of the plurality of compressibilities; and wherein the first of the plurality of compressibilities is less than the second of the plurality of compressibilities.

In yet a further aspect, a footwear device comprises a sole, the sole having a bottom surface, an outer edge and an inner edge, the footwear device being defined by a plurality of regions between the outer edge and the inner edge, the footwear device being further defined by a plurality of compressibilities, the footwear device further comprising a heel portion, a vertically disposed bore within the heel portion, and a shock absorber at least partially disposed within the bore; wherein at least a bottom surface of the shock absorber comprises a first of the plurality of regions; wherein a second of the plurality of regions is disposed adjacent the first of the plurality of regions; and wherein the second of the plurality of regions has a compressibility that is less than a compressibility of the first of the plurality of regions.

DETAILED DESCRIPTION

Figure 1:
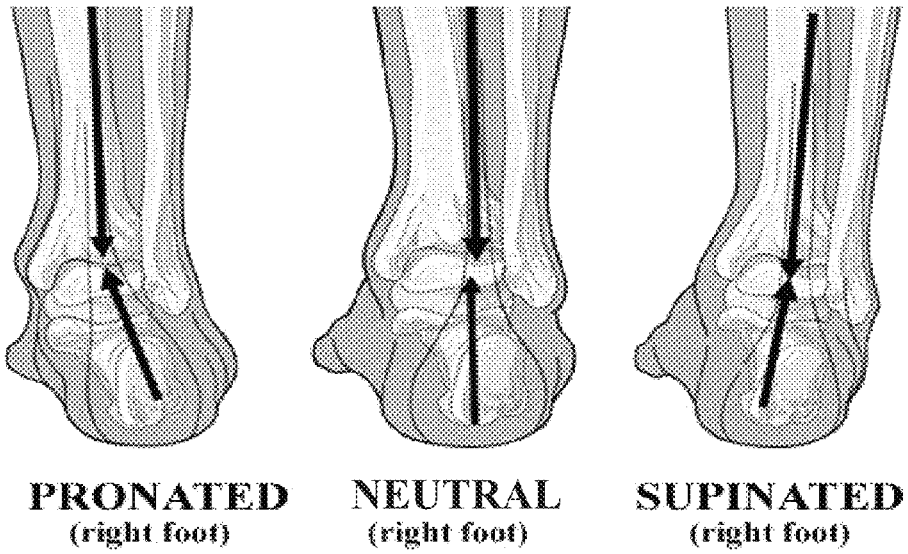
FIG. 1 is an illustrative example of a foot in pronated, neutral, and supinated positions.

Various embodiments will be described in detail with reference to the drawings, wherein like reference numerals represent like parts and assemblies throughout the several views. Reference to various embodiments does not limit the scope of the claims attached hereto. Additionally, any examples set forth in this specification are not intended to be limiting and merely set forth some of the many possible embodiments for the appended claims. Furthermore, it should be noted that drawings and components are not necessarily drawing to scale. Relative dimensions of the representations of certain components in the drawings can vary without departing from the purpose or function of the present disclosures.

FIG. 1 is an illustrative example of a foot in pronated, neutral, and supinated positions. In pronation the foot takes on a position in which most of the body weight is loaded onto the inner edge of the foot. In contrast, in supination the foot takes on a position in which the body weight is loaded onto the outer edge of the foot. In a neutral position the body weight is distributed more evenly across the entire bottom of the foot.

Figure 2:
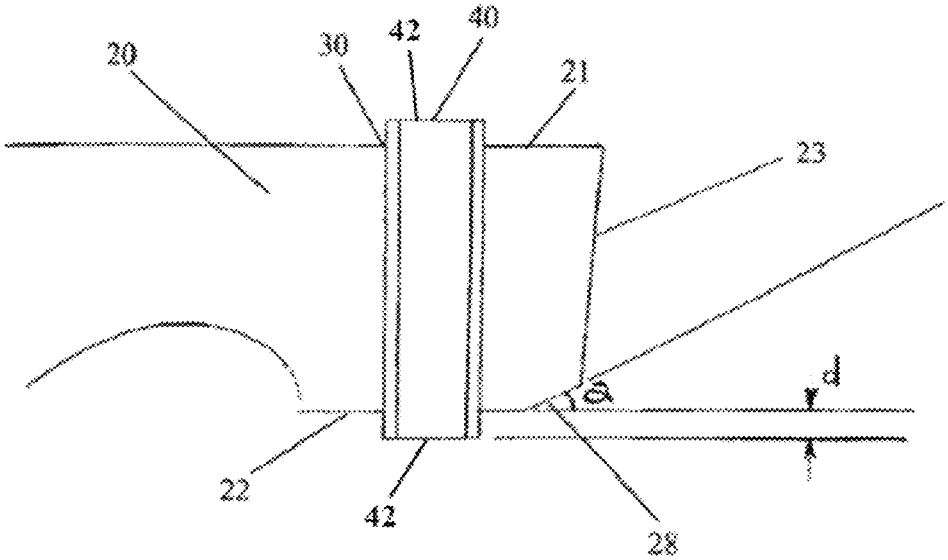
FIG. 2 illustrates a side view of the heel portion of the sole.

FIG. 2 illustrates a side view of the heel portion 20 of the sole of one embodiment of the present disclosure. In one embodiment, the sole comprises a heel portion 20 in which a bore 30 is formed, preferably at the center of the heel portion 20. A shock absorber 40 is inserted in the bore 30 in a manner such that the shock absorber 40 extends a distance beyond the bottom 22 and top 21 surfaces of the heel portion 20. In a preferred embodiment, during walking the extended shock absorber 40 always contacts the ground first. The sole bottom 22 begins to contact the ground only after the shock absorber 40 has been compressed. In this way, flexible material is allowed to be used in footwear while retaining stability and durability of the sole. The shock absorber 40, when contacting the ground and being compressed reduces the impact on the foot when the footwear contacts the ground and converts downward pressure applied by the wearer's weight to upward pressure which assists in walking and running. In addition, the shock absorber 40 helps the foot contact the ground at the correct location, thereby resisting pronation/supination.

A person having an excessive pronation/supination problem repeatedly puts his/her body weight on a side of the foot. As a result, the periphery of the heel portion 20 of the sole wears out quickly, causing a more severe problem. In preferred embodiments, to avoid this, the heel section 28 is formed at an angle $\alpha$ in the periphery of the heel portion 20 with respect to its bottom surface 22. It is desirable to incorporate an angle $\alpha$ in the whole back 23 lower end of the heel portion 20. The angle $\alpha$ is an angle greater than 0 degrees and less than 90 degrees. In some embodiments the angle $\alpha$ is in a range from about 10 degrees to about 60 degrees. In other embodiments the angle $\alpha$ is in a range from about 20 degrees to about 50 degrees.

In alternative embodiments, the heel lacks a support element and does not contain a bore for receiving that element. In these embodiments, the sole still contains the heel section 28 formed at an angle $\alpha$ in the periphery of the heel portion 20 with respect to its bottom surface 22. Without wishing to be bound to any particular theory, it is believed that heel section 28 can correct excessive pronation/supination problem all by itself, and that a support element, e.g., shock absorber 40, is optional.

The distance d that the shock absorber 40 extends beyond the bottom 22 surface of the heel portion 20 in a relaxed state should be within a suitable range. If the distance d is too small, the shock absorber 40 may not be able to separate the heel portion 20 of the sole from the ground after a long period of walking. If the distance d is too large, the wearer may experience an uncomfortable feeling. In one embodiment, the distance d is in a range from about 1/16 inch to about 1/4 inch, or alternatively about 1/8 inch to retain the function of the shock absorber 40 for an extended period without causing an uncomfortable feeling.

The shock absorber 40 in some embodiments is made of plastic, rubber or other cushioning materials. The shock absorber 40 can be formed into different shapes, which can include, but are not limited to, a cylinder, prism or cone. The example shown in FIG. 2 includes a cylindrically shaped shock absorber 40. Other embodiments include, for example, rectangular, elliptical, and other cross-sectional shapes. The bore 30 typically has a cross-sectional shape that matches the cross-sectional shape of the shock absorber 40. As such, the bore may also have, e.g., a cylindrical, rectangular, elliptical or other cross-sectional shape. The bore may be made of the same material that makes up the heel itself, i.e., the bore is an opening in a heel, or may be of a different material than can be inserted into an opening in the heel. In some embodiments corners and edges are rounded to reduce pressure points and to reduce the chance of catching on another object.

In some embodiments, the shock absorber 40 is slideably retained in the heel portion 20 and is not permanently secured to the heel portion 20. In this way the shock absorber is slidable within the bore 30 and can be replaced when worn out. Additionally, in some embodiments the shock absorber 40 can be made with open ends 42 (FIG. 2) so that it can be filled with a flexible material to absorb shock in a more efficient way.

As can be seen from FIG. 2, in this example the upper end of the shock absorber 40 also extends beyond the top surface 21 of the heel portion 20. The resistant force of the compressed shock absorber 40 acts on the wearer's heel, helping the wearer to walk easily.

Figure 3:
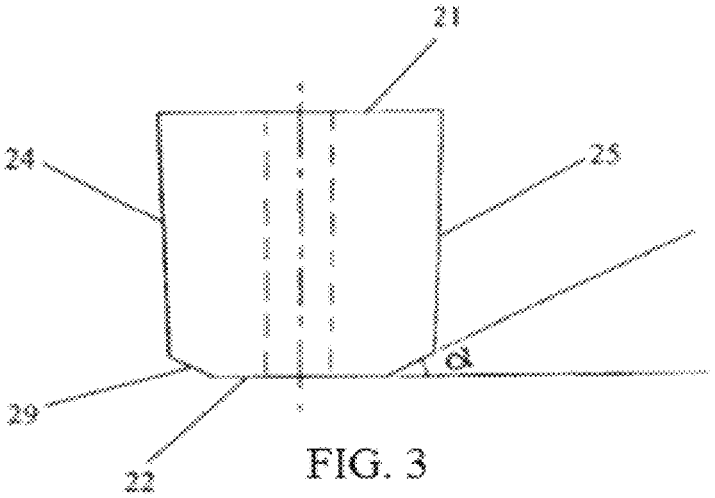
FIG. 3 is a rear view of the sole.

FIG. 3 is a rear view of the sole. In some embodiments, the left rear wall 24 and the right rear wall 25 of the heel portion 20 are also angled with an angle $\alpha$ in a tapered configuration with respect to the bottom 22 surface to avoid wear of the sole. In one embodiment, the tapered configuration 29 is applied around the whole bottom 22 heel portion 20 of the sole, including the front portion, so that the edges of the footwear do not touch the ground. In other embodiments, the tapered configuration is applied to the entire bottom 22 of heel portion 20 of the sole and also to the front portion of the sole.

Figure 4:
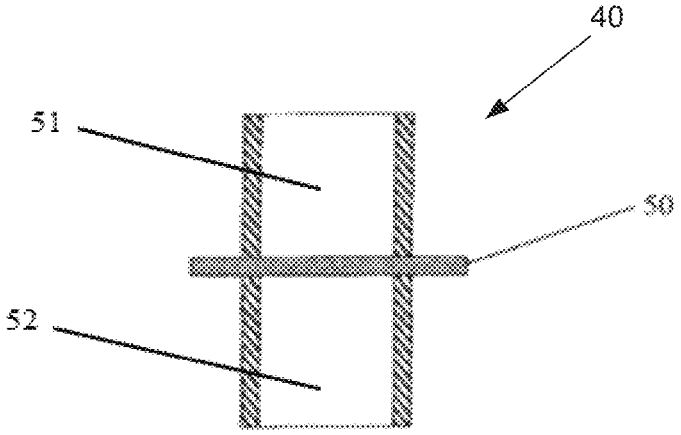
FIG. 4 is a cross-sectional view of a shock absorber, comprising an upper part and a lower part connected by a strip.

FIG. 4 is a cross-sectional view of one embodiment of the shock absorber 40, comprising an upper portion 51 and a lower portion 52 connected by a substrate. In this example, the substrate is a strip 50. In some embodiments, the strip 50 has at least one cross-sectional dimension greater than the upper portion 51 and the lower portion 52 extending into the sides of the bore 30 (FIG. 2). The strip 50 is used to support the shock absorber 40 within the bore 30 (FIG. 2) and prevent it from moving. In some embodiments the upper portion 51 and the lower portion 52 of shock absorber 40 are formed of a cushioning material, while the strip 50 is formed of either a cushioning material or a rigid material. In other embodiments, the upper portion 51 and the lower portion 52 of shock absorber 40 are formed of a rigid material, while the strip 50 is formed of a cushioning material to provide the cushioning for the shock absorber 40. The cushioning material is a material with at least greater flexibility than the rigid material.

Figure 5:
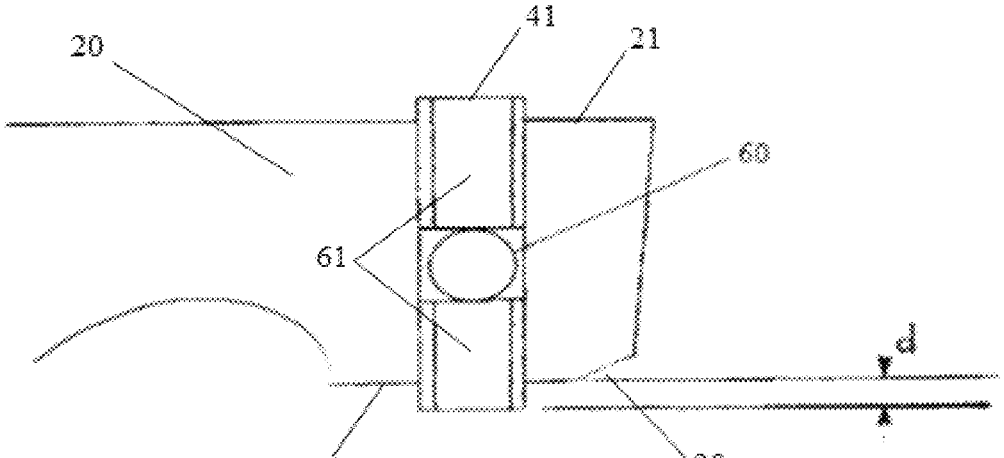
FIG. 5 illustrates a side view of the heel portion of the sole according to another embodiment of the present disclosure.

FIG. 5 is a side view of another embodiment of the present disclosure. The shock absorber 41 comprises two upper and lower portions 61 separated by a substrate 60. In some embodiments, the substrate 60 is a flexible substrate. The upper and lower portions 61 respectively extend beyond the top surface 21 and the bottom surface 22 of the heel portion 20 when the shock absorber is in a relaxed state (e.g., when no downward pressure is being applied by the user's foot). The physical property of the flexible substrate 60 can be adjusted according to different ground conditions. The use of flexible substrate 60 increases the compact resistance in a controlled way and further stabilizes the foot.

Some embodiments include a plurality of flexible substrates having different flexibilities. Also, in some embodiments at least one of the upper and lower portions is/are removable. The flexible substrates are replaceable within the bore to permit selective insertion of a flexible substrate having a desired flexibility according to the conditions or preferences of the wearer.

The distance d that the shock absorber 41 extends beyond the bottom surface 22 of the heel portion 20 should be within a suitable range. If the distance d is too small, the shock absorber 41 may not be able to separate the heel portion 20 of the sole from the ground after a long period of walk. If the distance d is too large, the wearer may experience an uncomfortable feeling. In one embodiment, the distance d is in a range from about 1/16 inch to about 1/4 inch, or alternatively about 1/8 inch to retain the function of the shock absorber 41 for an extended period without causing an uncomfortable feeling.

Figure 6:
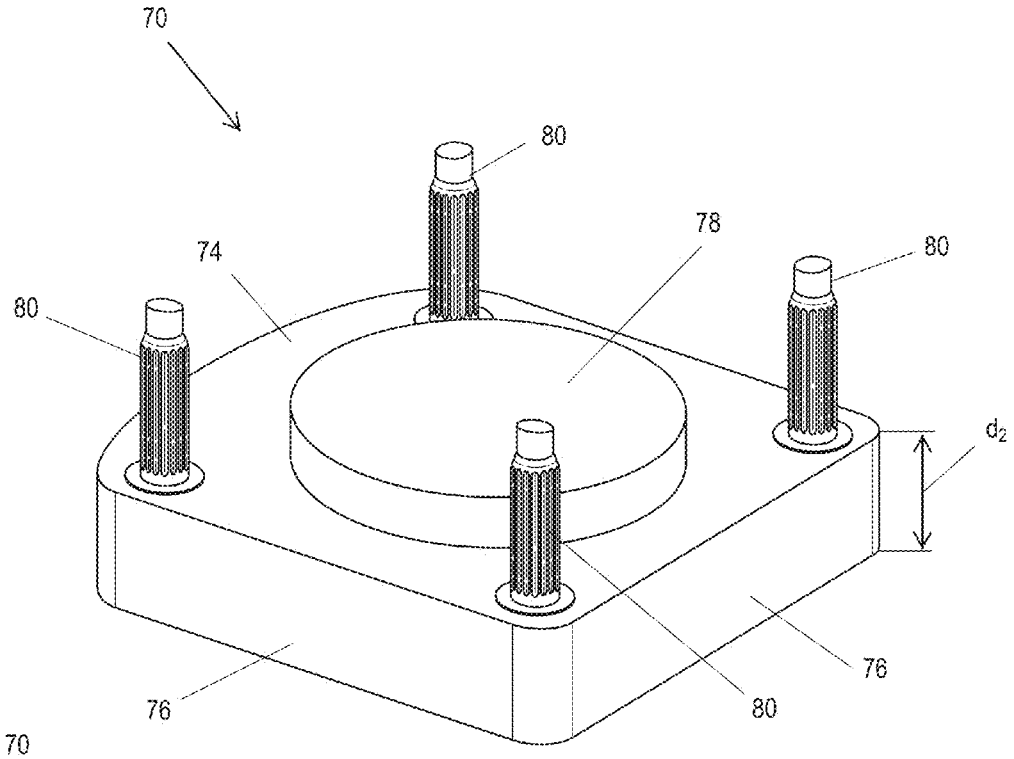
FIG. 6 is a top perspective view of an embodiment of a heel cap in accordance with the present disclosure.
Figure 7:
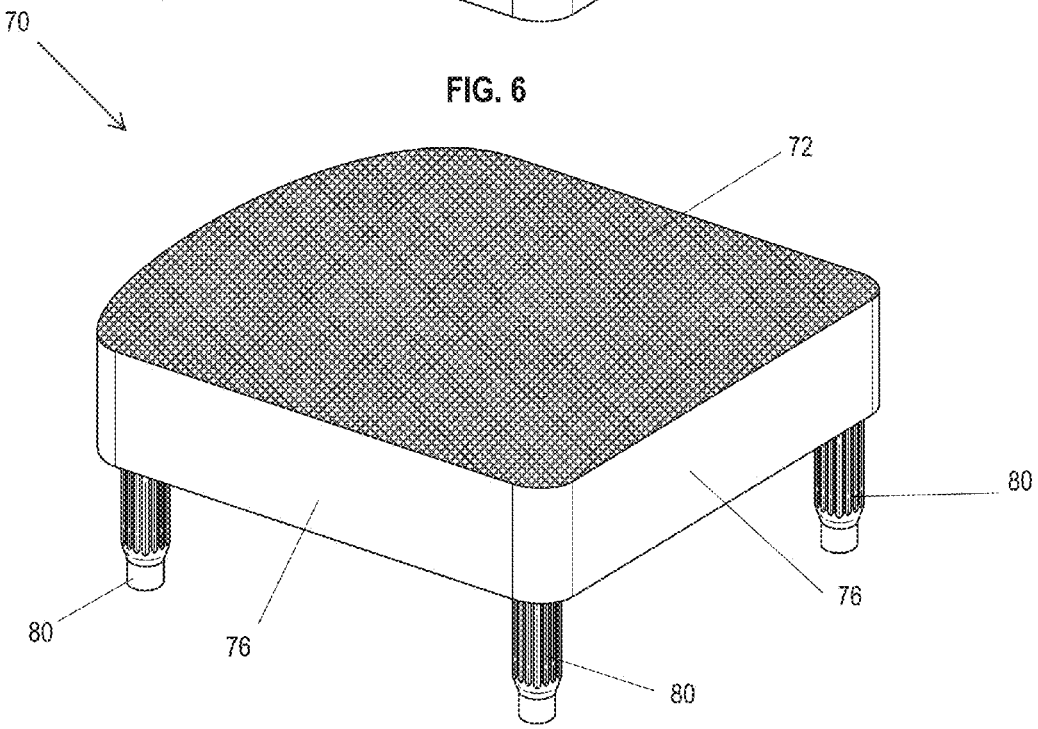
FIG. 7 is a bottom perspective view of the heel cap of FIG. 6.

FIG. 6 is a top perspective view of an embodiment of a heel cap in accordance with the present disclosure; FIG. 7 is a bottom perspective view of the example heel cap of FIG. 6. As shown in FIGS. 6-7, the example heel cap 70 includes a bottom surface 72, a top surface 74, side surfaces 76, a raised portion 78, and pegs 80.

Figure 13:
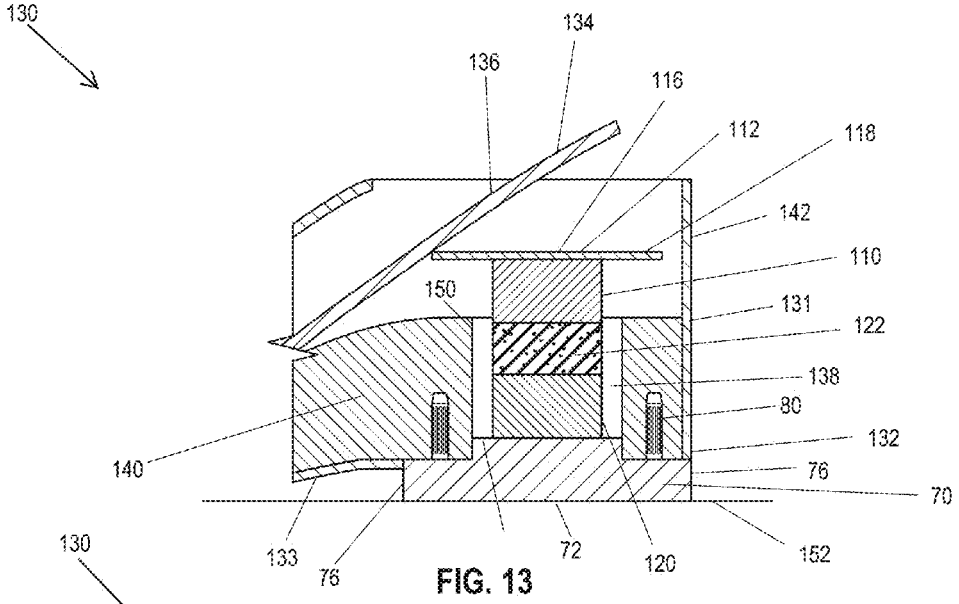
FIG. 13 is a schematic, side, cross-sectional view of the rear portion of the footwear, shock absorber, and heel cap combination of FIG. 12.

The example heel cap 70 can be secured to the bottom of the heel portion of an article of footwear to reinforce the heel and protect the heel from wear and tear associated with continued use. The heel cap 70 is placed on the heel such that the bottom surface 72 contacts the ground. When secured to the bottom of the footwear, the top surface 74 of the heel cap 70 abuts the bottom of the heel. The side surfaces 76 extend between the top surface 74 and the bottom surface 72. In different embodiments, one or more of the side surfaces 76 or one or more portions thereof are flat and/or alternatively rounded. Alternatively, the side surfaces 76 are contoured to match the contour of the adjacent heel against which the heel cap 70 is secured. The side surfaces 76 include a thickness $d_2$. The thickness $d_2$ is sufficient to withstand a desirable amount of wear and tear without damaging the heel against which the heel cap 70 is secured. In addition, or alternatively, $d_2$ is determined based on the desired distance by which the shock absorber 110 extends above the bore (such as the bore 30 described above or bore the 138 described below; FIG. 13) when in a relaxed state. In addition, or alternatively, $d_2$ is selected to provide a desirable amount of elevation to the footwear, such as in the case of high heeled shoes. In some examples, $d_2$ is in a range from about 1 mm to about 50 mm. In other examples, $d_2$ is about 9 mm. In other examples, $d_2$ falls outside of these ranges and values.

In some example embodiments, one or more of the side surfaces 76 or one or more portions thereof are angled consistent with the above description of FIGS. 2-3 in order to further aid in the correction of gait conditions such as pronation or supination by encouraging the heel of the foot to land squarely (i.e. neutrally) rather than at an angle to the ground. In some embodiments, $d_2$ varies between different parts of the heel cap 70. For example $d_2$ may vary such that the heel cap 70 is thicker towards the back of the footwear and thinner towards the front of the footwear (or vice versa) when the heel cap 70 is secured to the heel of the footwear.

The raised portion 78 is optional, and is configured to extend into a bore (such as the bore 30 described above or a bore 138 described below) in the heel of the footwear and thereby provide a platform upon which a shock absorber can rest and compress against, as will be discussed in greater detail below in connection with FIG. 13. The height of the raised portion 78 above the top surface 74 may be within a suitable range. For example, the height of the raised portion 78 may be based on a size of the footwear, a weight of the user of the footwear, an intended use of the footwear, a medical condition of the user, and/or the desired distance by which the shock absorber 110 extends above the bore when in a relaxed state. The raised portion 78 can be any suitable shape. In the example shown, raised portion 78 is cylindrical and configured to fit within a correspondingly round bore in the heel of the footwear. In alternative examples, the heel cap 70 does not include a raised portion 78, and instead has a flat top surface 74 uninterrupted except by one or more fasteners such as the pegs 80.

The heel cap 70 can be removeably and replaceably secured (such as after significant wear and tear) to the bottom of the heel of an article of footwear with one or more pegs 80 or other suitable fastening means, such as nails, screws, staples, pins, stitches, glue, and so forth. The number and configuration/placement of pegs 80 or other fasteners is not limited by the example shown in FIGS. 6-7. The one or more pegs 80 or other fasteners can be inserted into, or otherwise secured to, the material at the bottom of the outsole of the footwear, thereby securing the heel cap 70 to the bottom of the footwear.

Securing a heel cap such as the heel cap 70 to the heel of an article of footwear below a shock absorber prevents the shock absorber from undesirably falling out of the footwear. In addition, by covering the shock absorber, the heel cap 70 protects the shock absorber from damage that might otherwise be caused by the shock absorber's direct contact with the ground.

The example heel cap 70 can be manufactured from any suitably strong and durable material, such as rubber, plastic, wood, leather, metal, compressible material(s), and so forth.

Figure 8:
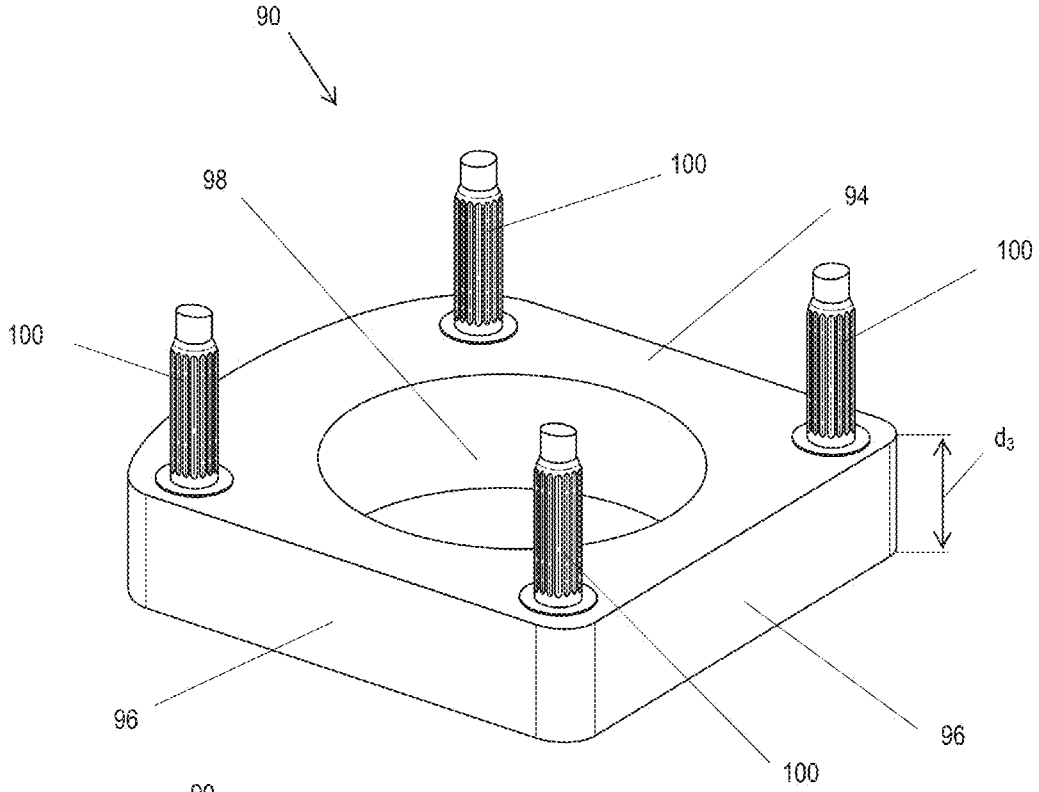
FIG. 8 is a top perspective view of a further embodiment of a heel cap in accordance with the present disclosure.
Figure 9:
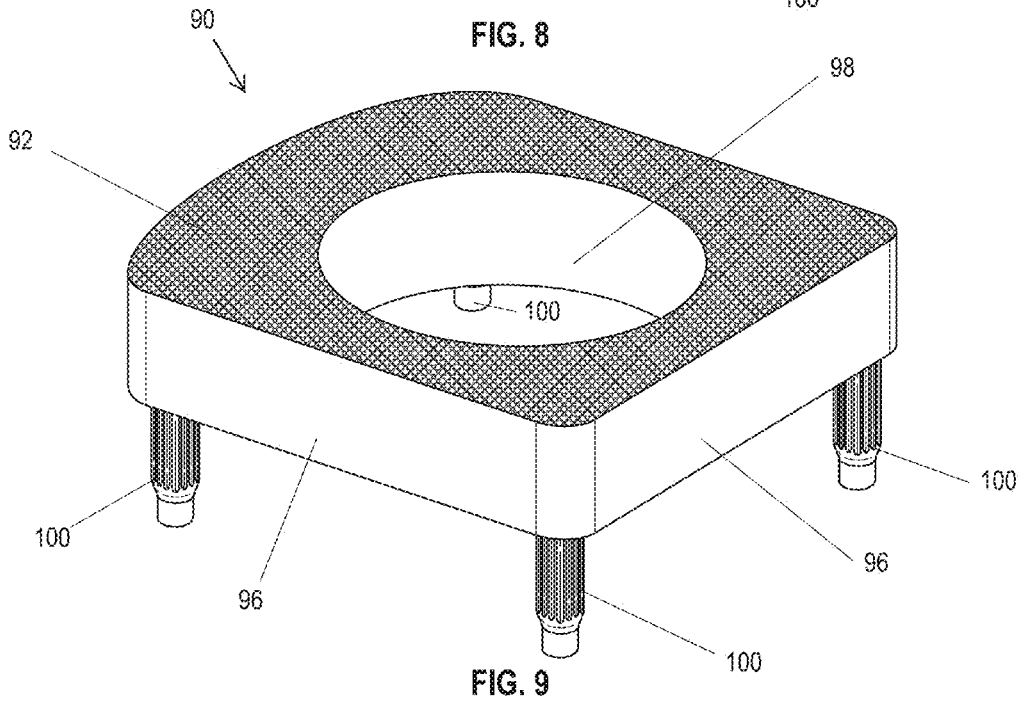
FIG. 9 is a bottom perspective view of the heel cap of FIG. 8.

FIG. 8 is a top perspective view of a further embodiment of a heel cap in accordance with the present disclosure; FIG. 9 is a bottom perspective view of the example heel cap of FIG. 8. As shown in FIGS. 8-9, example heel cap 90 includes a bottom surface 92, a top surface 94, side surfaces 96, opening 98, and pegs 100.

Figure 14:
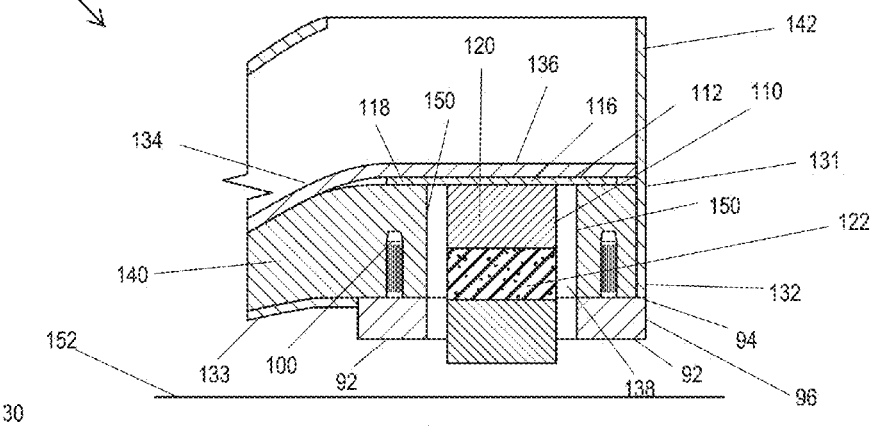
FIG. 14 is a schematic, side, cross-sectional view of the rear portion of an article of footwear including the shock absorber of FIG. 10 in a relaxed state, and the heel cap of FIG. 8.

Example heel cap 90 can be secured to the bottom of the heel portion of an article of footwear to reinforce the heel and protect the heel from wear and tear associated with continued use. The heel cap 90 is placed on the heel such that the bottom surface 92 contacts the ground upon sufficient downward pressure to compress a shock absorber as described in more detail below. When secured to the bottom of the footwear, the top surface 94 of the heel cap 90 abuts the bottom of the heel of the footwear. The side surfaces 96 extend between the top surface 94 and the bottom surface 92. In different embodiments, one or more of the side surfaces 96 or one or more portions thereof are flat and/or alternatively rounded. Alternatively, the side surfaces 96 are contoured to match the contour of the adjacent heel against which the heel cap 90 is secured. The side surfaces 96 include a thickness $d_3$. The thickness $d_3$ is sufficient to withstand a desirable amount of wear and tear without damaging the heel or outsole against which the heel cap 90 is secured. In addition, or alternatively, $d_3$ is determined based on the distance the lower portion of the shock absorber 110 extends beyond the lower surface of the footwear (FIG. 14). In addition, or alternatively, $d_3$ is selected to provide a desirable amount of elevation to the footwear, such as in the case of high heeled shoes. In some examples, $d_3$ is in a range from about 1 mm to about 50 mm. In other examples, $d_3$ is about 9 mm. In other examples, $d_3$ falls outside of these ranges and values.

In some example embodiments, one or more of the side surfaces 96 of the heel cap 90 or one or more portions thereof are angled consistent with the above description of FIGS. 2-3 in order to further aid in the correction of gait conditions such as pronation or supination by encouraging the heel of the foot to land squarely (i.e. neutrally) rather than at an angle to the ground. In some embodiments, $d_3$ varies between different parts of the heel cap 90. For example, $d_3$ may vary such that the heel cap 90 is thicker towards the back of the footwear and thinner towards the front of the footwear (or vice versa) when the heel cap 90 is secured to the heel of the footwear.

The opening 98 extends through the entire thickness $d_3$ of the heel cap 90 and is configured to receive a portion of the bottom of a shock absorber (such as the shock absorber 40 described above or the shock absorber 110 described below). In this manner, the opening 98 permits a shock absorber to extend beyond the bottom of the heel and the heel cap 90 and contact the ground directly, as will be discussed further in connection with FIGS. 14-15. The opening 98 can be any suitable shape, and need not match the shape of the shock absorber or the bore. The opening 98 may be formed preferably at the center of heel cap 90 and aligned with the heel of the footwear. The width of the opening 98 may be determined based on dimensions of the shock absorber 110. In the example shown, the opening 98 is round and configured to receive a correspondingly round or cylindrical shock absorber.

The heel cap 90 can be removeably and replaceably (such as after significant wear and tear) secured to the bottom of the heel of an article of footwear with one or more pegs 100 or other suitable fastening means, such as nails, screws, staples, pins, stitches and the like. The number and configuration of pegs 100 or other fasteners is not limited by the example shown in FIGS. 8-9. The one or more pegs 100 or other fasteners can be inserted into, or otherwise secured to, the material at the bottom of the heel portion or outsole of the footwear, thereby securing the heel cap 90 to the bottom of the footwear.

The example heel cap 90 is manufactured from any suitably strong and durable material, such as rubber, plastic, wood, leather, metal, compressible material(s), and so forth.

Figure 10:
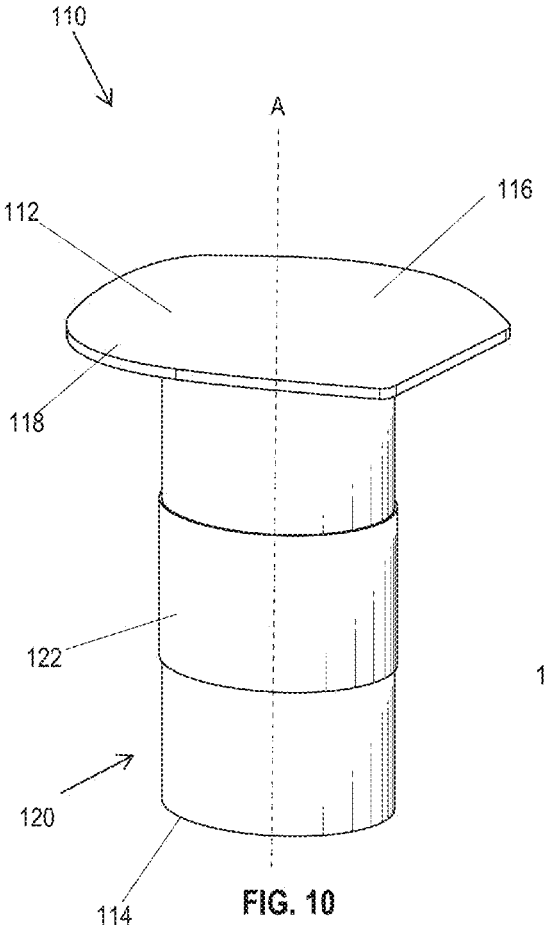
FIG. 10 is a top perspective view of an embodiment of a shock absorber in accordance with the present disclosure illustrating the shock absorber in a relaxed state.
Figure 11:
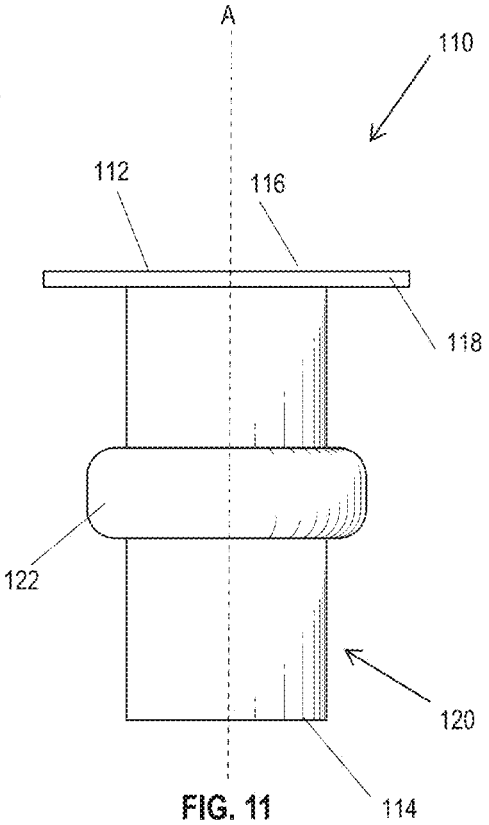
FIG. 11 is a side view of the shock absorber of FIG. 10 illustrating the shock absorber in a compressed state.

FIG. 10 is a top perspective view of an embodiment of a shock absorber 110 in accordance with the present disclosure illustrating the shock absorber in a relaxed state; FIG. 11 is a side view of the shock absorber 110 of FIG. 10 illustrating the shock absorber in a compressed state. As shown in FIGS. 10-11, an example shock absorber 110 includes a top 112, a bottom 114, an optional upper plate 116, an optional flange 118, an elongate member 120, and a compressible material 122. The shock absorber 110 is defined by a longitudinal axis A from which the various aspects of the shock absorber 110 extend transversely outward.

The example shock absorber 110 is configured to be housed in a bore (such as the bore 30 discussed above or the bore 138 discussed below) in the heel of an article of footwear, such that the top 112 of the shock absorber 110 is disposed below or near the insole of the footwear, and the bottom 114 of the shock absorber 110 is disposed within or below the heel of the footwear. The optional upper plate 116 is disposed at the top 112 of the shock absorber 110 and, optionally, has a flange 118 that extends transversely outward beyond at least a portion of the elongate member 120. The flange 118 of the upper plate 116 is configured to extend beyond the top edge of the bore (such as the bore 30 discussed above or the bore 138 discussed below). In some embodiments, when the shock absorber 110 is in a compressed state, the flange 118 rests on the top of a floor plate in an article of footwear. In alternative embodiments, when the shock absorber 110 is in compressed state, the flange 118 rests on the top of an insole in an article of footwear. In yet further alternative embodiments, when the shock absorber 110 is in a compressed state, the flange 118 rests on an upper portion of the outsole of an article of footwear. In still further alternative embodiments, the flange 118 rests on any of the footwear components just described even when the shock absorber 110 is in a relaxed state (as shown in FIG. 10, for example). The flange 118 thus prevents the shock absorber 110 from falling through the opening in the heel of the footwear. The upper plate 116 can be any suitable shape such as square, rectangular, triangular, round, irregular, or otherwise, without departing from its purpose and function. In some embodiments, the upper plate 116 is sufficiently thin so as to be undetectable or substantially undetectable by the user's foot when the foot applies pressure on the shock absorber 110. In alternative embodiments the upper plate is thick enough to be detectable under the foot.

The elongate member 120 extends downward from the upper plate 116. The elongate member 120 can be any suitable shape. In this embodiment the elongate member 120 is cylindrical and configured to be received by a correspondingly tubular bore in the heel of an article of footwear. In some embodiments, the elongate member 120 in a relaxed state is longer along longitudinal axis A than the thickness of the footwear heel in which it is housed. In some embodiments, a portion towards the top of the elongate member 120 (i.e. the portion adjacent the top 112 of the shock absorber 110) extends above the top of the outsole of an article of footwear when the elongate member is in a relaxed state. In yet further embodiments, a portion towards the bottom of the elongate member 120 (i.e. the portion adjacent the bottom 114 of the elongate member 120) extends below the bottom of the heel of the footwear when the elongate member 120 is in relaxed state. In still further embodiments, a portion towards the top of the elongate member 120 extends above the top of the outsole of an article of footwear and a portion towards the bottom of the elongate member 120 extends below the bottom of the heel of the footwear when the elongate member 120 is in a relaxed state. When the elongate member 120 is in a compressed state (as shown in FIG. 11, for example), in some embodiments the elongate member 120 is entirely contained within the heel; in alternative embodiments, one or both of the top portion of the elongate member 120 and the bottom portion of the elongate member 120 extends beyond the top of the outsole or the bottom of the heel, respectively.

The elongate member 120 includes a compressible material 122. The compressible material 122 allows the shock absorber 110 to compress along its longitudinal axis A when force is exerted along that axis, such as the force of a foot pressing down on the upper plate 116 of the shock absorber 110. The compressible material 122 can be disposed at any location along the longitudinal length of the elongate member 120. In some embodiments, the entirety of the elongate member 120 is the compressible material 122. In other embodiments, only a portion of the elongate member 120 is the compressible material 122. In such embodiments, the compressible material 122 can be disposed near the top of the elongate member 120, near the bottom of the elongate member 120 or somewhere in the middle, as shown in the example shock absorber 110 in FIG. 10.

The compressible material 122 is selected from materials (or a combination of materials) that reduce in volume when pressure is applied and return to their full volume, or near full volume, uncompressed state when that pressure is released. A non-limiting example of a suitable compressible material 122 is a closed-cell polyurethane foam rubber.

In some embodiments, the compressible material 122 is selected such that when it is compressed along the longitudinal axis A of the shock absorber 110, at least a portion of the compressible material 122 expands transversely outward away from axis A, as shown in FIG. 11. Outward transverse expansion of the compressible material 122 results in a transverse force or pressure on the wall(s) of the bore (such as the bore 30 described above or the bore 138 described below) in the footwear, corresponding to transverse dissipation of the perpendicular vertical force applied by the foot when taking a step. Without wishing to be bound to any particular theory, it is believed that such transverse expansion of the compressible material 122 upon perpendicular vertical compression of the compressible material 122 enhances the shock absorbing characteristics of the shock absorber 110, and also enhances the shock absorber's ability to correct for excessive supination or pronation of the gait. Likewise, it is believed that the inward transverse reaction force/pressure applied by the wall(s) of the bore (such as bore 30 described above or bore 138 described below) in response to the transverse expansion of the compressible material 122 also enhances the shock absorbing characteristics of the shock absorber 110, and also enhances the shock absorber's ability to correct for excessive supination or pronation of the gait.

Figure 12:
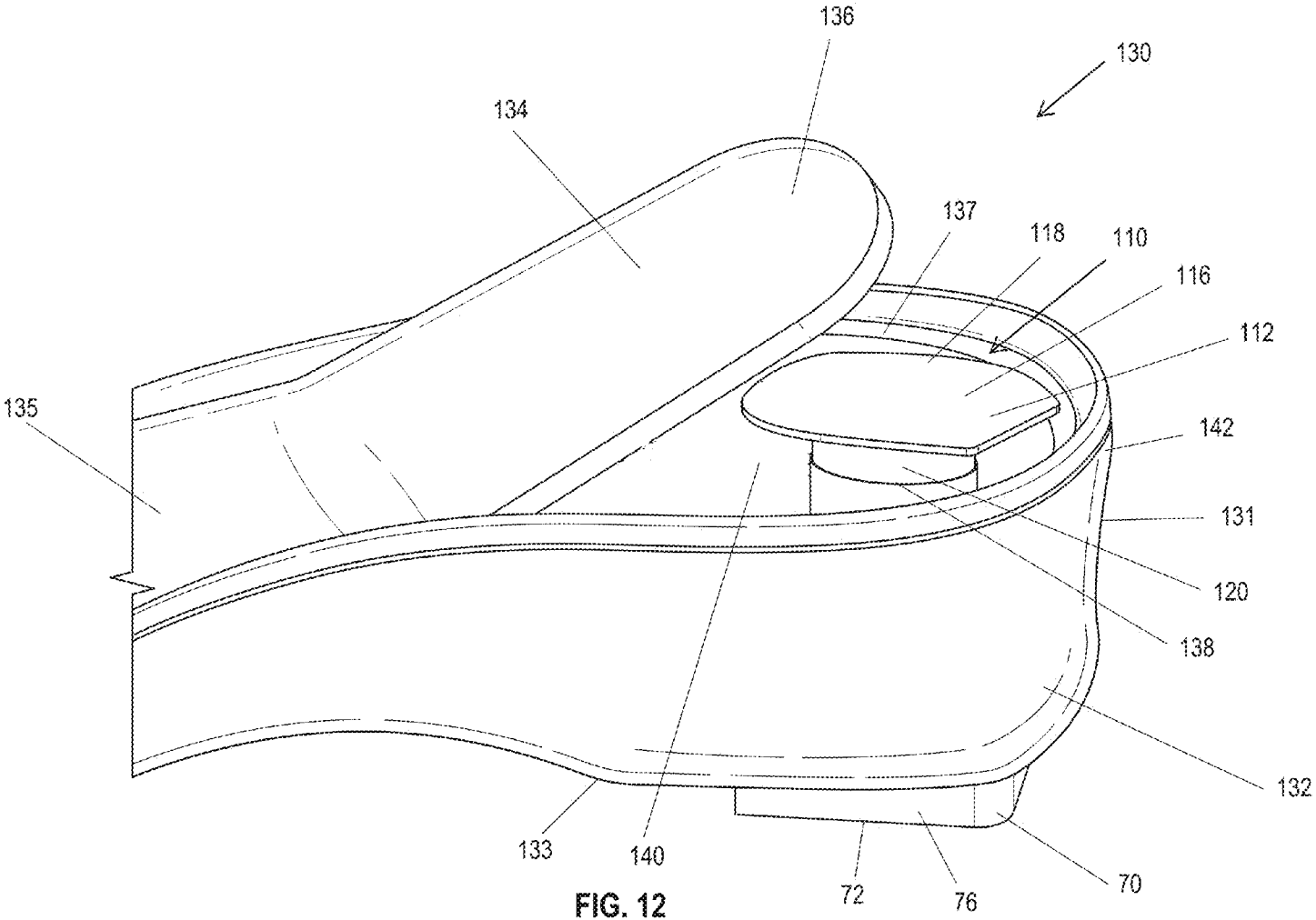
FIG. 12 is a top schematic perspective view showing portions of the rear part of an article of footwear including the shock absorber of FIG. 10 and the heel cap of FIG. 6.

FIG. 12 is a top schematic perspective view showing portions of the rear part of an article of footwear including the shock absorber 110 of FIG. 10 and the heel cap 70 of FIG. 6. The footwear 130 includes a heel cap 70, with its bottom surface 72 and its side surfaces 76, as discussed above. In addition, the footwear 130 includes a shock absorber 110, having a top 112, upper plate 116, flange 118, and elongate member 120 as discussed above. In this example, the footwear 130 also includes a rear end 131, a heel portion 132, an outsole bottom 133, a floor plate 134 having a front portion 135 and rear portion 136, a support ledge 137, a bore 138, a support system 140; and the heel portion 132 has a top 142.

As shown in FIG. 12, the heel cap 70 is secured to the footwear 130 towards its rear end 131 under the heel portion 132 on the outsole bottom 133 of the footwear 130. Fasteners (such as the pegs 80 described above in connection with FIG. 6) are embedded in the support system 140 to secure the heel cap 70 to the heel portion 132.

The floor plate 134 of the footwear 130 provides a substantially firm surface on which to place an insole, for example. Alternatively, the user's foot can be placed directly on the floor plate 134. In this example, a front portion 135 of the floor plate 134 is secured to the footwear through conventional fastening means, such as staples, nails, glue and so forth, while a rear portion 136 of the floor plate 134 is not secured to the footwear 130, thereby allowing the elongate member 120 to expand upwards (i.e. away from the heel cap 70) into its relaxed state by pushing upwards on the rear portion 136 of the floor plate 134. In this embodiment, the floor plate 134, where secured to the footwear, is fastened onto the support ledge 137 which lines a perimeter of the footwear 130.

The bore 138 is disposed vertically within the support system 140 that occupies at least some of the space between the top 142 of the heel portion 132 and the outsole bottom 133 of the footwear 130. In some embodiments the bore 138 is aligned with the heel cap 70. The elongate member 120 of the shock absorber 110 is disposed within the bore 138, with the bottom 114 of the shock absorber (see FIG. 10) resting against the raised portion 78 (see FIG. 6) of the heel cap 70. The raised portion 78 (FIG. 6) elevates the shock absorber 110 in its relaxed state relative to its position in its compressed state, thereby allowing for a greater degree of vertical compression along axis A (FIG. 11) for enhanced shock absorbing characteristics. Thus, with specific reference to the embodiment shown in FIG. 12, the raised portion 78 (FIG. 6) of the heel cap 70 increases the distance by which the shock absorber 110 extends above the support ledge 137 when the shock absorber 110 is in its relaxed state. A depth of the bore 138 and a longitudinal length of the shock absorber 110 may be determined based on one or more parameters such as a size of the footwear, a weight of the user of the footwear, an intended use of the footwear, and a medical condition of the user.

The support system 140 can include any material, materials, or configuration of one or more materials and/or structures sufficient to provide for a bore 138 having a rigid interior surface as described below. In some embodiments, the support system 140 includes a tube or other hollow structure in which the bore 138 is disposed. In some embodiments the support system 140 is an integral part of the heel portion 132 and/or the outsole of the footwear. In some embodiments, the support system is configured to support fasteners that secure the heel cap 70 to the heel portion 132. In some embodiments, the support system 140 is configured to support the elements of the footwear that rest on the support system 140 for support. In some embodiments, such elements can include, by way of non-limiting examples, the floor plate 134, the flange 118 of the shock absorber 110 when the shock absorber 110 is in a compressed state, an insole, the support ledge 137, and the weight of a person's foot. In some embodiments, the support system 140 is continuous and solid throughout. In other embodiments the support system 140 is discontinuous and/or contains one or more cavities of empty space to reduce the overall weight of the footwear 130.

In alternative embodiments to that shown in FIG. 12, the bore 138 extends through an opening in the floor plate 134 and the shock absorber 110 extends above the floor plate 134 (e.g. through an opening in the rear portion 136 of the floor plate 134), and the flange 118 rests on the top of the bore 138 (i.e. on top of the floor plate 134) when the shock absorber 110 is in a compressed state. In these embodiments, when the shock absorber 110 is in a relaxed state, and the heel cap 70 is affixed to the bottom of the footwear 130, the top 112 of the shock absorber 110 extends above the floor plate 134. In addition, in these embodiments, the raised portion 78 (FIG. 6) of the heel cap 70 increases the distance by which the shock absorber 110 extends above the floor plate 134 when the shock absorber 110 is in its relaxed state.

In further alternative embodiments, the bore 138 extends through an opening in the floor plate 134 and through an opening in an insole placed on the floor plate 134, and the shock absorber 110 extends above both the floor plate 134 and an insole placed on the floor plate 134 (e.g. through an opening in the rear portion 136 of the floor plate 134 and a corresponding opening in the insole), and the flange 118 rests on the top of the bore 138 (i.e on top of the insole) when the shock absorber 110 is in a compressed state. In these embodiments, when the shock absorber 110 is in a relaxed state, and the heel cap 70 as affixed to the bottom of the footwear 130, the top 112 of the shock absorber 110 extends above the floor plate 134 and also above the insole. In addition, in these embodiments the raised portion 78 (FIG. 6) of the heel cap 70 increases the distance by which the shock absorber 110 extends above the insole when the shock absorber 110 is in its relaxed state.

FIG. 13 is a schematic, side, cross-sectional view of the rear portion of the footwear 130, the shock absorber 110, and the heel cap 70 combination of FIG. 12. The footwear 130 includes: a heel cap 70 with its bottom surface 72, side surfaces 76, raised portion 78, and pegs 80; a shock absorber 110 having a top 112, upper plate 116, flange 118, elongate member 120, and compressible material 122; a rear end 131; a heel portion 132; an outsole bottom 133; a floor plate 134 having a rear portion 136; a bore 138; a support system 140; the heel portion 132 having a top 142, as discussed above. Additionally in this example, the bore 138 includes an interior surface 150, and the bore 130 is shown resting on the ground 152.

In the example depicted in FIG. 13, the shock absorber 110 is shown in a relaxed state (e.g. without any downward pressure being applied from a person's foot) within the bore 138 in the heel portion 132. The top 112 of the shock absorber 110 extends above the bore 138. The shock absorber 110 rests on the raised portion 78 of the heel cap 70, which increases the distance by which the top 112 of the shock absorber 110 extends above the bore 138 when in a relaxed state. In this example, the raised portion 78 of the heel cap 70 is aligned with the bore 138. Without wishing to be bound to any particular theory, it is believed that the extension upward of the shock absorber 110 when in its relaxed state enhances the shock absorber's ability to correct for excessive supination or pronation of the gait by encouraging the user to step squarely (i.e. neutrally) on the shock absorber, 110, which is disposed at or near the center of the heel portion 132. The pegs 80 are shown embedded in the support system 140, thereby securing the heel cap 70 to the heel portion 132.

The shock absorber 110 is compressed when, e.g., a foot applies downward pressure onto the rear portion 136 of the floor plate 134. Applying downward force causes the shock absorber 110 to compress between the floor plate 134 and the raised portion 78 of the heel cap 70. Compression continues until the flange 118 of the shock absorber 110 rests on the support system 140 surrounding the top of the bore 138, preventing further compression of the shock absorber 110. In some embodiments, there is a gap between at least a portion of the shock absorber 110 and the interior surface 150 of the bore 138 when the shock absorber 110 is in a relaxed stated. In some embodiments, there is no gap between the shock absorber 110 and the interior surface 150 of the bore when the shock absorber is in a relaxed state. In some embodiments, when the shock absorber 110 is compressed in the manner just described, the compressible material 122 shrinks longitudinally (FIGS. 10-11) while expanding transversely outward such that at least a portion of the compressible material 122 contacts and presses against the interior surface 150 of the bore 138. Without wishing to be bound to any particular theory, it is believed that such transverse expansion of the compressible material 122 upon perpendicular vertical compression of the compressible material 122 enhances the shock absorbing characteristics of the shock absorber 110, and also enhances the shock absorber's ability to correct for excessive supination or pronation of the gait. Likewise, it is believed that the inward transverse reaction force/pressure applied by the wall(s) of the bore (such as bore 30 described above or bore 138 described below) in response to the transverse expansion of the compressible material 122 also enhances the shock absorbing characteristics of the shock absorber 110, and also enhances the shock absorber's ability to correct for excessive supination or pronation of the gait. In this example, the interior surface 150 is tubular and sufficiently rigid to push back against compressible material 122 in its compressed state. However, other formations of the interior surface would also be suitable.

Figure 15:
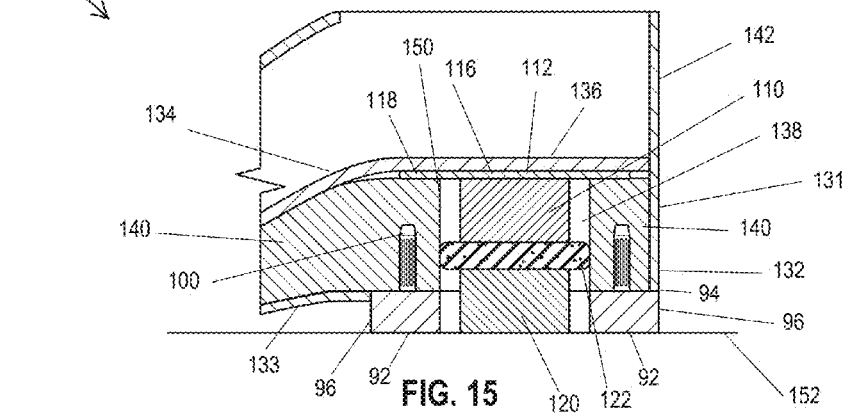
FIG. 15 is a schematic, side, cross-sectional view of the rear portion of the article of footwear, shock absorber, and heel combination of FIG. 14, illustrating the shock absorber in a compressed state.

FIG. 14 is a schematic, side, cross-sectional view of the rear portion of an article of footwear 130 including the shock absorber 110 of FIG. 10 in a relaxed state, and the heel cap 90 of FIG. 8; FIG. 15 is a schematic, side, cross-sectional view of the rear portion of the footwear 130, shock absorber 110, and heel cap 90 combination of FIG. 14, illustrating the shock absorber in a compressed state. With reference to FIGS. 14-15, the footwear 130 includes: a heel cap 90 with its bottom surface 92, top surface 94, side surfaces 96, opening 98, and pegs 100; a shock absorber 110 having a top 112, upper plate 116, flange 118, elongate member 120, and compressible material 122; a rear end 131; a heel portion 132; a bottom 133; a floor plate 134 having a rear portion 136; a bore 138; a support system 140; the heel portion 132 having a top 142, as discussed above. The bore 138 includes an interior surface 150, also discussed above. In addition, in FIG. 14 the footwear 130 is shown elevated above the ground 152; in FIG. 15 the footwear 130 is shown resting on the ground 152.

In the example depicted in FIG. 14, the shock absorber 110 is shown in a relaxed state (e.g. without any downward pressure being applied from a person's foot or with any upward pressure being applied by the ground 152) within the bore 138 in the heel portion 132. In this example, the opening 98 of the heel cap 90 is aligned with the bore 138. Unlike the embodiment shown in FIG. 13, in FIG. 14 the top 112 of the shock absorber rests against the support system 140, even when the shock absorber 110 is in a relaxed state. The shock absorber 110 then extends through the bore 138 and the opening 98 in the heel cap 90, such that the bottom of the shock absorber 110 extends below the heel cap 90, similar to the embodiment of FIG. 5. Without wishing to be bound to any particular theory, it is believed that the extension of the shock absorber 110 below the heel cap 90 when the shock absorber 110 is in its relaxed state enhances the shock absorber's ability to correct for excessive supination or pronation of the gait by encouraging the user to step squarely (i.e. neutrally) on the shock absorber 110, which is disposed at or near the center of the heel portion 132. The pegs 100 are shown embedded in the support system 140, thereby securing the heel cap 90 to the heel portion 132.

The shock absorber 110 is compressed when, e.g., a foot applies downward pressure onto the rear portion 136 of the floor plate 134 while the footwear is on the ground 152 as depicted in FIG. 15. Applying such downward force causes the shock absorber 110 to compress between the floor plate 134 and the ground 152. Compression continues until the bottom of the shock absorber 110 is level with the bottom surface 92 of the heel cap 90 (i.e. the bottom of the heel cap 90 rests on the ground 152), preventing further compression of the shock absorber 110. In some embodiments, when the shock absorber 110 is compressed in this manner, the compressible material 122 shrinks longitudinally (FIGS. 10, 11, 15) while expanding transversely outward such that at least a portion of the compressible material 122 contacts and presses against the interior surface 150 of the bore 138. Without wishing to be bound to any particular theory, it is believed that such transverse expansion of the compressible material 122 upon perpendicular vertical compression of the compressible material 122 enhances the shock absorbing characteristics of the shock absorber 110, and also enhances the shock absorber's ability to correct for excessive supination or pronation of the gait. Likewise, it is believed that the inward transverse reaction force/pressure applied by the wall(s) of the bore (such as bore 30 or the bore 138) in response to the transverse expansion of the compressible material 122 also enhances the shock absorbing characteristics of the shock absorber 110, and also enhances the shock absorber's ability to correct for excessive supination or pronation of the gait. In this example, the interior surface 150 is tubular and sufficiently rigid to push back against compressible material 122 in its compressed state. However, other formations of the interior surface would also be suitable.

In other embodiments, the heel cap is not present and the bore does not extend all the way through the bottom of the heel. Here, the bore 30, 138 forms a well in which the shock absorber 110 is placed. This embodiment is related to the embodiment described in FIG. 13, except that the heel cap is not removable, and is instead fused with the heel portion of the footwear.

In some embodiments of the present disclosure, different areas (i.e., regions) of the footwear have different hardnesses to aid users suffering from supination or pronation and to reduce the degree and/or incidence of uneven wear and tear on the bottom of the footwear that may result from such gait conditions. For example, to help alleviate supination the footwear sole has one or more areas near the outstep of the shoe that is/are harder than the adjacent area. The harder area contacts the ground before the softer area contacts the ground, thereby providing support to the user and/or reducing wear/erosion of the adjacent softer area.

To help alleviate pronation, the footwear sole has one or more areas near the instep of the shoe that is/are harder than the adjacent area. The harder area contacts the ground before the softer area contacts the ground, thereby providing support to the user and/or reducing wear/erosion of the adjacent softer area.

Similarly, an area abutting the shock absorber may be harder than the adjacent area of the shock absorber. In the case of pronation or supination, the area abutting the shock absorber contacts the ground before the softer area, thereby providing support to the user and/or reducing wear/erosion of the shock absorber. In some examples the harder area abutting the shock absorber can slide up and down relative to the bottom of the shoe sole independently of the shock absorber.

In another specific embodiment, the shock absorber itself includes an interior region that can be softer or harder than an abutting it. In the case of pronation or supination, a harder outer region of the shock absorber could contact the ground before the inner region, thereby providing support to the user and/or reducing wear/erosion of the inner region.

It should be appreciated that the harder areas can be fully customizable in size, shape, placement, and/or degree of hardness, each of which may be customized to the particular user's gait and/or orthopedic or other medical needs.

Figure 16:
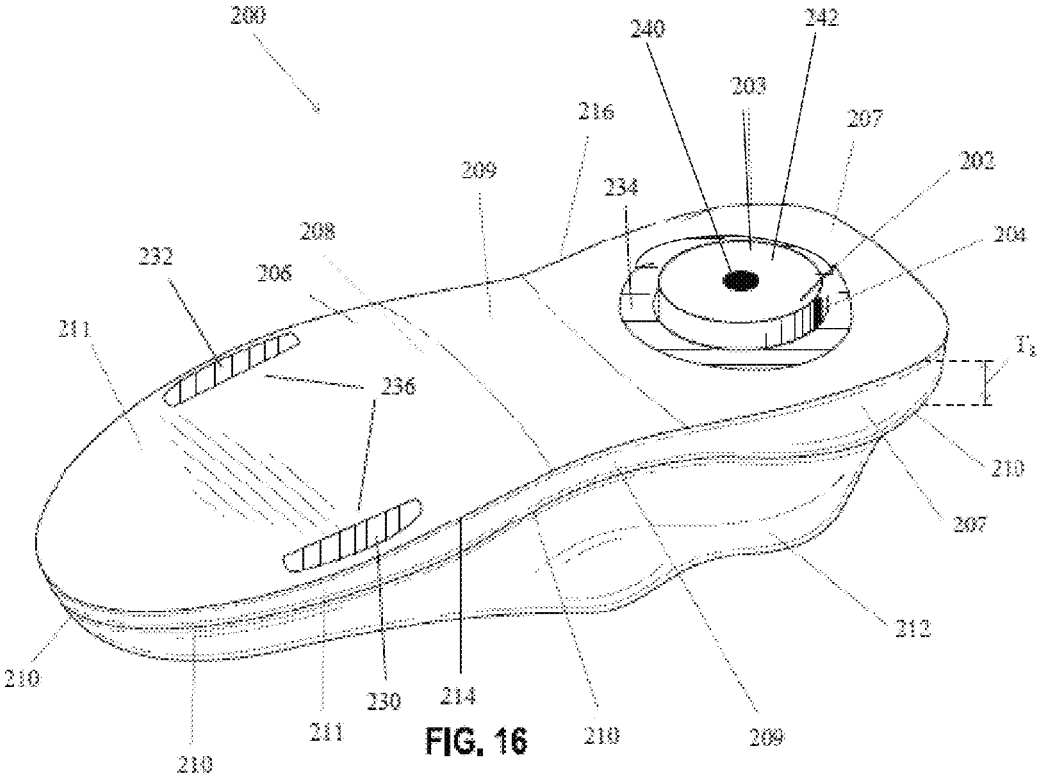
FIG. 16 is a bottom view of an example article of footwear according to an alternative embodiment of the present disclosure.

FIG. 16 is a bottom view of an example article of footwear 200. The footwear 200 optionally includes a shock absorber 202 having a bottom end 203. The footwear 200 optionally includes a bore 204. The footwear 200 also includes a sole 206 having a heel portion 207, a bottom surface 208, an optional arch portion 209, an upper limit 210 and a front portion 211. The footwear 200 also includes an upper portion 212, and the bottom surface 208 includes an inner edge 214 and an outer edge 216.

The footwear 200 can be any of a variety of types of footwear, such as sneakers, sandals, dress shoes, flats, high-heeled shoes, boots, slippers, open toed shoes, close toed shoes, and so forth.

In those embodiments of the footwear 200 that include the shock absorber 202, the shock absorber 202 is at least partially disposed within the bore 204. In some examples the bottom end 203 of the shock absorber 202 extends beyond the bottom surface 208 of the sole 206 when the shock absorber 202 is in a relaxed (i.e., uncompressed) state. The degree to which the shock absorber 202 extends beyond the bottom surface 208 of the sole 206 can vary and is not limited by what is shown in FIG. 16. The bore 204 is disposed within the heel portion 207 of the sole 206. The shock absorber 202 is consistent with any one or more of the shock absorbers described herein, such as the shock absorbers 40, 41 (FIGS. 2, 4, 5) and/or the shock absorber 110 (FIGS. 10-15). In some examples, the heel portion 207 can include a heel cap, such as the heel cap 90 (FIGS. 8-9, 14-15) as described above. The shock absorber 202 and the bore 204 can be any desired geometric configurations. In the example shown, the shock absorber 202 is cylindrical, and the bore 204 is tubular. In some examples, the bore 204 is defined by a tube, the tube optionally consisting of at least a portion of the third area 234, described in greater detail below.

One or more areas of the bottom surface 208 of the sole 206 and the bottom end 203 of the shock absorber 202 (if a shock absorber is present) contact the ground during walking, running, and the like. The arch portion 209 (if present) connects the heel portion 207 to the front portion 211 of the sole 206.

The sole 206 has a thickness $T_1$ as measured between the bottom surface 208 and the upper limit 210. In some examples $T_1$ is uniform throughout the various portions of the sole 206, including the front portion 211, the arch portion 209, and the heel portion 207. In alternative examples, $T_1$ is variable. For example, $T_1$ can be largest in the heel portion 207 and smallest in the front portion 211.

The bottom surface 208 of the heel portion 207 of the sole 206 can be flat, substantially flat, or one or more portions thereof can be angled in a tapered configuration as described above in connection with FIGS. 2-3.

The shock absorber 202 (if present) is defined by at least one compressibility $C_1$. At least a portion of the sole 206 is defined by a compressibility $C_2$. In some examples multiple portions or the entirety of the sole 206 are defined by the compressibility $C_2$. In other examples one or more portions of the sole 206 is/are defined by a compressibility that differs from both $C_1$ and $C_2$. In still further examples, one or more portions of the sole 206 is/are defined by the compressibility $C_1$, one or more portions of the sole 206 is/are defined by the compressibility $C_2$ and, optionally, one or more portions of the sole 206 is/are defined by one or more further compressibilities other than $C_1$ and $C_2$. By compressibility is meant the amount of deformation in response to a given amount of applied pressure (such as pressure from walking). The greater the deformation in response to the given applied pressure, the greater the compressibility.

In some examples of the article of footwear 200, a first portion of the sole is defined by the compressibility $C_1$ and a second portion of the sole 206 is defined by a compressibility $C_2$, with $C_2$ being less than $C_1$. The $C_2$ compressibility is accomplished by selecting one or more materials or material configurations for that portion or those portions of the sole 206 where the $C_2$ compressibility is desired. The material or materials (or configuration(s)) are selected to result in the compressibility $C_2$ when positioned within the thickness $T_1$ of the sole 206. In some examples the aforementioned selected material or materials (or configuration(s)) span the entire thickness $T_1$ of the sole 206 in the selected portion(s) of the sole 206. In other examples, the aforementioned selected material(s) (or configuration(s)) span less than the entirety of the thickness $T_1$. In still further examples, the aforementioned selected material(s) (or configuration(s)) span the entirety of the thickness $T_1$ in some portion or portions of the sole 206, and less than the entirety of the thickness $T_1$ in one or more other portions of the sole 206.

In a particular embodiment, one or more areas of the sole 206, such as a first area 230, a second area 232, and/or a third area 234, have a compressibility $C_2$ that is less than the compressibility $C_1$ of a portion of the sole or shock absorber abutting and/or adjacent the given area. Without wishing to be bound to any particular theory, it is believed that lesser compressibility at or towards the inner edge 214 (e.g., at the first area 230) with relatively greater compressibility in a fourth area 236 abutting the first area 230 aids users with pronation as the first area 230 contacts the ground before the fourth area 236 contacts the ground, thereby providing support to the user and/or reducing wear/erosion of the softer fourth area 236; similarly, it is believed that lesser compressibility at or towards the outer edge 216 (e.g., at the second area 232) with relatively greater compressibility in the fourth area 236 abutting the second area 232 aids users with supination, as the second area 232 contacts the ground before the fourth area 236 contacts the ground, thereby providing support to the user and/or reducing wear/erosion of the softer fourth area 236. Likewise, in those examples in which the footwear 200 includes a shock absorber 202 housed in a bore 204, it is believed that partially or entirely surrounding the bore 204 with a third area 234 of material having a lesser compressibility relative to a fifth area 242 adjacent the third area 234, can aid users with supination or pronation, as the third area 234 contacts the ground before the fifth area 242 contacts the ground, thereby providing support to the user and/or reducing wear/erosion of the softer fifth area 242.

In some examples, the third area 234 is slidable within the sole 206, and is capable of extending below the bottom surface 208 of the sole 206 independently of the slidability of the shock absorber 202. In some examples, the compensation provided by the third area 234 and/or the fifth area 242 to a user with supination or pronation results in the area of the sole 206 around the third area 234 wearing out more evenly over time.

In a further particular embodiment in which the footwear 200 includes the shock absorber 202 and the bore 204, a sixth area 240 of the shock absorber 202 has a greater or lesser compressibility relative to the fifth area 242 of the shock absorber 202 that abuts the sixth area 240. The fifth area 242 could contact the ground before or after the sixth area 240.

It should be appreciated that the area or areas of the sole 206 and/or the shock absorber 202 having relatively low compressibility can be fully customizable in size, shape, placement, and/or degree of compressibility, each of which may be customized to the particular user's gait and/or orthopedic or other medical needs. It should also be appreciated that footwear having soles 206 with added features can be adapted in accordance with these principles. For example, if the footwear 200 includes a heel cap (e.g., the heel cap 190 (FIGS. 8-9)), one or more portions of the heel cap can have a compressibility that is less than the compressibility of an abutting portion of the heel cap, consistent with this disclosure.

Figure 17:
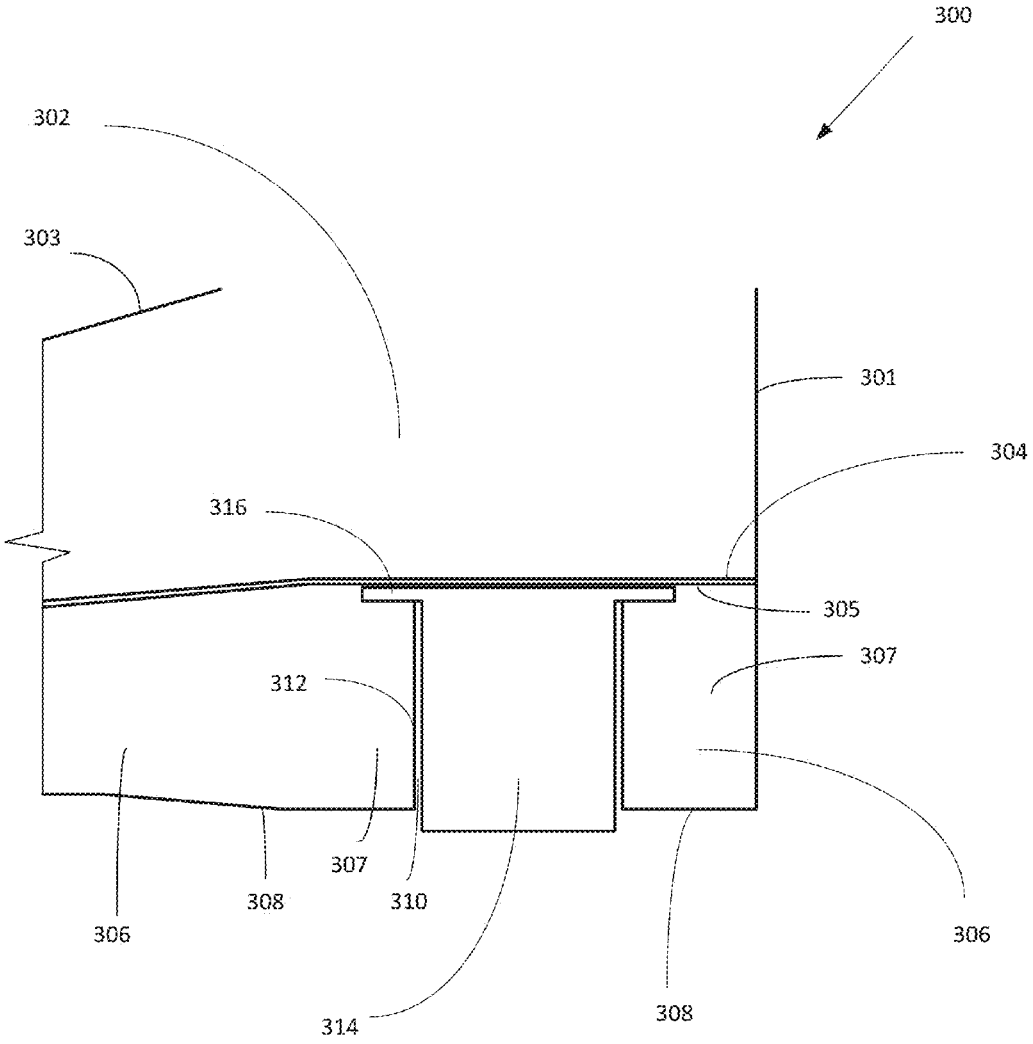
FIG. 17 is a schematic cross-sectional view of a rear portion of an article of footwear in accordance with a further alternative embodiment of the present disclosure.

In still further embodiments, a bore in the heel portion of the footwear forms a well that is open at a first end disposed at the bottom of the footwear and closed at an opposing end, with a shock absorber (such as any of the shock absorbers described in this specification) disposed in the bore. In these embodiments, the footwear may or may not include a heel cap. FIG. 17 is a schematic cross-sectional view of a rear portion of an article of footwear in accordance with one such embodiment. With reference to FIG. 17, the footwear 300 includes a back 301, a top 303, and an interior space 302 to house the foot of a wearer of the footwear 300. The interior space 302 has a lower surface 304, e.g., an insole. In addition, the footwear 300 includes an outsole 306 having a heel portion 307 and a bottom 308. Disposed in the heel portion is a well 310, which is laterally bounded by a wall 312. A shock absorber 314 (consistent with the characteristics of any of the shock absorbers described in this application) is disposed within the well 310. Optionally, a flange 316 at the top of the shock absorber 314 is disposed above the wall 312 and extends laterally beyond the wall 312 to retain the shock absorber 314 within the well 310 in the manner described above (e.g., with reference to the flange 118). Other means for retaining the shock absorber 314 within the well 310 may also be employed, e.g., by affixing (e.g., with glue, fasteners, etc.) an upper surface of the shock absorber 314 to a bottom 305 of the lower surface 304. The lower surface 304 closes off the well 310. In addition, the lower surface 304 is fixed in place. That is, compression or decompression of the shock absorber 314 (e.g., while the wearer is walking) does not cause displacement of the lower surface 304. This may increase the comfort of the wearer of the footwear 300, while still providing the wearer with shock absorption, since a portion of the shock absorber 314 in an uncompressed state extends below the bottom 308 of the outsole 306 and compresses against the ground in a fashion similar to that described with reference to FIG. 14. Optionally, the outsole 306 and/or the shock absorber 314 may have regions of differing compressibility to support wearers of the footwear 300 who suffer from pronation or supination, as described above in connection with FIG. 16.

The various embodiments described above are provided by way of illustration only and should not be construed to limit the claims attached hereto. Those skilled in the art will readily recognize various modifications and changes that may be made without following the example embodiments and applications illustrated and described herein, and without departing from the true spirit and scope of the following claims.

What is claimed is:

1. A footwear device comprising:

a sole, the sole comprising a heel portion, a bottom surface, an outer edge and an inner edge, the footwear device being defined by a plurality of regions between the outer edge and the inner edge;

an opening disposed in a bottom surface of the heel portion, a vertically disposed bore within the heel portion, the vertically disposed bore extending from the opening, a shock absorber comprising a bottom surface and having a relaxed state and a compressed state, the shock absorber being at least partially disposed within the bore, the shock absorber extending below the bottom surface of the heel portion when the shock absorber is in the relaxed state;

wherein at least a first portion of the bottom surface of the shock absorber defines a first of the plurality of regions;

wherein an area on the bottom surface of the heel portion surrounding the shock absorber defines a second of the plurality of regions; and wherein a second portion of the bottom surface of the shock absorber defines a third of the plurality of regions, the second portion being farther from the inner edge and the outer edge than the first portion.

2. The footwear device of claim 1, wherein the third of the plurality of regions is less compressible than the first of the plurality of regions.

3. The footwear device of claim 1, wherein the third of the plurality of regions is more compressible than the first of the plurality of regions.

4. The footwear device of claim 1, wherein the first of the plurality of regions is configured to contact the ground before the second of the plurality of regions.

5. The footwear device of claim 1, further comprising a fourth and a fifth of the plurality of regions disposed in front of the heel portion, wherein the fourth of the plurality of regions is disposed nearer the outer edge than the fifth of the plurality of regions, and wherein the fourth of the plurality of regions is less compressible than the fifth of the plurality of regions.

6. The footwear device of claim 1, further comprising a fourth and a fifth of the plurality of regions disposed in front of the heel portion, wherein the fourth of the plurality of regions is disposed nearer the inner edge than the fifth of the plurality of regions, and wherein the fourth of the plurality of regions is less compressible than the fifth of the plurality of regions.

7. The footwear device of claim 1, wherein the first of the plurality of regions is more compressible than the second of the plurality of regions.

8. The footwear device of claim 1, wherein the vertically disposed bore defines a vertical direction of the shock absorber, and wherein in the compressed state at least a portion of the shock absorber is expanded in a horizontal direction, the horizontal direction being perpendicular to the vertical direction.

9. The footwear device of claim 8, further comprising a gap between at least a portion of the shock absorber and an interior surface of the bore when the shock absorber is in the relaxed state, and wherein in the compressed state at least a portion of the shock absorber is expanded into the gap.

10. The footwear device of claim 9, wherein in the compressed state at least a portion of the shock absorber applies pressure to the interior surface of the bore.

11. The footwear device of claim 1, wherein the bore comprises a top and the shock absorber extends above the top of the bore when the shock absorber is in the relaxed state.

12. The footwear device of claim 1, wherein the first portion of the bottom surface of the shock absorber is configured to contact the ground before the second portion of the bottom surface of the shock absorber.

13. The footwear device of claim 1, further comprising a gap, and wherein in the compressed state at least a portion of the shock absorber is expanded into the gap.

14. The footwear device of claim 1, wherein in the compressed state at least one region of the shock absorber compresses vertically and expands horizontally.

15. The footwear device of claim 14, wherein the bore is defined by a wall, and wherein compression of the shock absorber produces a force applied between the shock absorber and the wall of the bore.

* * * * *